US007572205B1

(12) United States Patent
Cribar

(10) Patent No.: US 7,572,205 B1
(45) Date of Patent: Aug. 11, 2009

(54) SYSTEM AND METHODOLOGY FOR ENDURANCE TRAINING

(76) Inventor: Raymond C. Cribar, 5439 Golden Willow Dr., Fort Collins, CO (US) 80528-6396

( * ) Notice: Subject to any disclaimer, the term of this patent is extended or adjusted under 35 U.S.C. 154(b) by 0 days.

(21) Appl. No.: 11/467,005

(22) Filed: Aug. 24, 2006

Related U.S. Application Data

(60) Provisional application No. 60/596,056, filed on Aug. 27, 2005.

(51) Int. Cl.
*A63B 71/00* (2006.01)

(52) U.S. Cl. ..... 482/3; 482/8

(58) Field of Classification Search ..... 482/1–9; 463/6; 700/91
See application file for complete search history.

(56) References Cited

U.S. PATENT DOCUMENTS 3,492,582 A * 1/1970 Heywood ..... 340/323 R
5,476,427 A * 12/1995 Fujima ..... 482/3
5,490,816 A * 2/1996 Sakumoto ..... 482/3
5,526,290 A * 6/1996 Kanzaki ..... 702/160
5,938,564 A * 8/1999 Bachman ..... 482/3
6,013,008 A * 1/2000 Fukushima ..... 482/8
6,356,856 B1 * 3/2002 Damen et al. ..... 702/160
6,837,827 B1 * 1/2005 Lee et al. ..... 482/8
2004/0224740 A1 * 11/2004 Ball et al. ..... 463/6
2004/0224741 A1 * 11/2004 Jen et al. ..... 463/6
2005/0059495 A1 * 3/2005 Horowitz et al. ..... 463/42
2005/0096109 A1 * 5/2005 McNutt et al. ..... 463/6
2005/0096110 A1 * 5/2005 Ohyagi et al. ..... 463/6
2005/0288081 A1 * 12/2005 Amaitis et al. ..... 463/6
2005/0288154 A1 * 12/2005 Lee et al. ..... 482/3
2006/0154713 A1 * 7/2006 Sunazuka et al. ..... 463/6
2006/0217231 A1 * 9/2006 Parks et al. ..... 482/3

* cited by examiner

*Primary Examiner*—LoAn H. Thanh
*Assistant Examiner*—Sandhara M Ganesan
(74) *Attorney, Agent, or Firm*—Rick Martin; Patent Law Offices of Rick Martin, P.C.

(57) ABSTRACT

A method and system for assisting a user in maintaining a predetermined pace along a track with a specific predetermined end goal. The preferred embodiment uses a PDA or similar device to allow a user set a specific course goal and to enter (or download) a previous profile pace target along with checkpoint data for a specified track, detecting start/stop and checkpoints along a course, normalizing the user time at each checkpoint and providing wireless speech 'behind/ahead' feedback (either time or energy) to a user at each checkpoint along a specified track. The present invention may provide the user with a variable pace along a track or course utilizing upcoming terrain, percentage of work completed and/or user power profiles and may normalize a user goal to other competitors having faster or slower track times.

3 Claims, 6 Drawing Sheets

SYSTEM AND METHODOLOGY FOR ENDURANCE TRAINING

CROSS-REFERENCE TO RELATED APPLICATION

This application is a non-provisional application claiming the benefits of provisional application No. 60/596,056 filed Aug. 27, 2005.

REFERENCES CITED

U.S. Pat. No. 6,837,827 B1 issued to Lee et al. dated Jan. 4, 2005.

FIELD OF THE INVENTION

The present invention relates broadly to a Global Positioning System (GPS) type device to enhance physical training. More particularly, the present invention concerns a physical training system and methodology utilizing target race history data concerning a race pace and comparing it to real-time GPS data associated (and optionally power meter data) with checkpoints along a race track and communicating to the user a normalized pace audible and/or visual checkpoint with respect to the time and/or distance and/or energy ahead or behind a goal time/and or goal energy of the target race.

BACKGROUND OF THE INVENTION

Athletes who train for competitive racing strive to improve their individual endurance and performance throughout their exercise program. Runners, bikers, skiers, rowers etc. may elect to improve their time over a given course or they may elect to lengthen the distance at which they can perform at a fixed time. Goals can be arrived at by history data of an individual or by history data of other individuals who have also performed over a given track.

Prior art cycle devices have utilized a cyclocomputer type device mounted on a bicycle to calculates and display trip information, similar to the instruments in the dashboard of a car. A basic cyclocomputer may display the current speed, maximum speed, trip distance, trip time, total distance traveled, and the current time. More advanced models also may display altitude, incline, and temperature as well as offer additional functions such as average speed, pedaling cadence and a stopwatch. They do not provide any user feedback with respect to checkpoint goals along a track.

Power meters exist to measure power output in watts, typically by using a torque sensor in the bottom bracket or rear hub. User power curves can be calculated depending on terrain for predictions of pace along a track. Power meters can be used to calculate the amount of work a user does along a course but are not used in prior art.

Other devices such as heart rate monitors can also be utilized during a race.

U.S. Pat. No. 6,837,827 B1 issued to Wai C. Lee et al. presents a personal training device using GPS data to assist a user in reaching performance goals. The device allows goal and performance information to be loaded and assists a user with audible cues in beep form during a track.

What is needed is a system and methodology that will allow users to compete over a given track against a preset plurality of checkpoint goals. Preferably the system can give the user audible speech feedback, using upcoming terrain and power predictions to normalize user pace and to determine user time behind or ahead of a pace goal for each checkpoint. (or energy behind or ahead of an energy goal). Preferably the system can have a hands free operation, and provide software running on an existing standard operating system and running on an existing hardware platform.

SUMMARY OF THE INVENTION

The primary aspect of the present invention is to provide normalized real-time user feedback on a 'pace' computer system throughout a track in which a user goal is predetermined for each of a plurality of checkpoints.

Another aspect of the present invention is to utilize upcoming terrain (or currents) and work completed in providing the user with pace feedback of pace along the set course for each of a plurality of checkpoints.

Another aspect of the present invention is to allow the user to race against a profiled target race and/or a set goal for a given course.

Another aspect of the present invention is to provide wireless speech audio feedback to a user concerning the user pace with respect to time 'ahead' or 'behind' a predetermined goal.

Yet another aspect of the present invention is to utilize existing hardware platforms, software applications and operating systems for user interfacing.

Still another aspect of the present invention is to provide the ability to 'normalize' paces, particularly against faster competitors.

Another aspect of the present invention is to provide for utilization of user power measurements and work completed when looking ahead at upcoming terrain (or current) for pace predictions.

Another aspect of the present invention is to allow a plurality of users to upload one or more track pace profiles into an internet web site for subsequent downloading to their 'pace' computer system for sharing and competing.

Other aspects of this invention will appear from the following description and appended claims, reference being made to the accompanying drawings forming a part of this specification wherein like reference characters designate corresponding parts in the several views.

This invention provides a novel method to create comparative and normalized feedback of user checkpoints along a track in assisting a user with endurance training. The system and methodology of the present invention utilizes a platform application to take into account upcoming terrain (or currents) which effect the user's (athlete's) speed. The present invention will provide the user with audio/visual feedback at checkpoints by either a time and/or distance ahead or behind at each checkpoint. The time ahead and/or behind will be normalized with respect to a finishing goal or competitor's pace.

Further details of the present invention will be described below.

The present invention provides a system and methodology for endurance training with a platform application that will run on an existing operating system such as Windows Mobile® and also run on existing hardware such as a personal digital assistant (PDA), palm, pocket PC, laptop or other existing handheld type device.

The term PDA will be used herein to describe the hardware platform. Various operating systems run on PDA's such as Palm OS™, Symbian OS™, Linux and Windows Mobile® to name a few. The preferred embodiment of the present invention utilizes Windows Mobile® as the operating system (O/S) of choice. Typical PDA's include, but are not limited to, a HP iPAQ hw6515 or HP IPAQ hw6915®, or other devices provided by various manufacturers such as Garmin® i-Que M5 etc. Various communication companies such as Verizon®, Cingular®, and T-Mobile® etc support these PDA's. These devices combine computing, telephone/fax, Internet, WiFi, GPS and networking features and are continuously being updated with more and more features. A typical PDA can function as a cellular phone, Global Positioning System (GPS), digital camera, video recorder, fax sender, Web browser and personal organizer and more. Some PDAs can also react to voice input by using voice recognition technologies. Features and applications are continually added and updated. PDA's have evolved to contain user applications, as with the present invention, which can be installed on their O/S such as Windows Mobile®. PDAs are easily mounted to a user via an armband, waistband, jersey pocket etc. Hands free operation of the present invention is a significant advantage, especially for runners and cross-country skiers. Since the course is pre-selected, and the unit is attached to the body before the user lines up at the start, there is no need to look at the wrist or push a button at the start, during the race or at the finish. This is a significant improvement over prior art, for example, consider a gloved cross country skier who is using their arms to propel them and cannot stop to push a button or interact with a device. Hands free operation also is an aide to cyclists who find it distracting to push a button before or after an intense interval. Also, accuracy is improved since it doesn't rely on human reaction time.

The present invention will also utilize Bluetooth® wireless control for communication between a PDA and a hands free headset.

The system of the present invention consists of the following features:

1. Runs on a wide variety of existing hardware platforms.
2. Provides a platform application to run on a common O/S such as Windows Mobile®.
3. Computes a variable pace for a course that has either previously been raced (and logged) or plotted via the web site based on a user's goal time for the course.
4. Notifies the user with speech audible and/or visual checkpoint updates to keep the user on a pace for a computed goal to achieve the specified goal time. Feedback can be either time or distance or both with respect to ahead or behind a calculated goal. Wireless feedback is provided in the preferred embodiment via a Bluetooth headset. Alternate embodiments would include a wired headset.
5. Calculation of checkpoint pace determined by the time at which a previous logged race was done at the respective checkpoint(s) and normalizing such to a specified user goal. This calculation will determine how far ahead/behind the user is at the respective checkpoint as compared to the race target pace. Normalization is done by taking the difference between the target race's elapsed time and the goal time and multiplying by the percentage of work done at that point on the course. The algorithm takes into consideration upcoming terrain wind speed, current etc. to predict the user's pace ahead or behind.
6. Allows race data to be shared by uploading one or more sets of race data to a web site. The user can then select one or more data sets for a given track for downloading thus allowing users to race against one or more other users' times along a given track. This allows a user to set a goal time based other user's actual (recorded and uploaded) race time.
7. Provides user feedback via checkpoint detection without the need of user interacting with the device at the start or during a race along a specified track.
8. Provides the ability to normalize another competitor's faster/slower pace to a given user goal. For example, if a user wishes to normalize a faster competitors pace, it will normalize the pace against a user's predefined goal. Thus on a track in which a user wants to set a goal of 20 minutes, for example, against a faster competitor who can complete the track in 18 minutes, the application of the present invention will normalize the competitor's pace to 20 minutes.
9. Provides normalization in a logical manner. For example, it will take less time off any downhill terrain versus uphill terrain along a track.
10. Provides the ability of the user to input power measurement data to be used by the application for time predictions based on the upcoming terrain.
11. Utilizes the percentage of work completed at a checkpoint in normalizing user pace.
12. Automatic detection of start/stop points without user input. This is done using a combination of comparing the distance to the start/stop positions relative to a specified threshold and comparing the bearing to the start/stop positions relative to a specified threshold.
13. Utilizes wind speed data in races where a follow-vehicle is allowed or other means of wind speed input. Wind speed and direction can be attained through a digital anemometer and weather vane and transmitted wirelessly to the PDA. The PDA could then calculate and normalize the goal pace during each leg of the course based upon wind speed and direction.
14. Provides the ability to use power meters in giving the user a 'power' feedback. For example, a wattage profile at each position along the course could be stored, and the user could be given checkpoints in terms of energy ahead or behind (as well as time and/or distance). For example, at a checkpoint the user would hear and audible such as "129 joules ahead". The wattage could be transmitted wireless to the device from a power meter, for example, attached to a bike.

Each target race will be defined by a starting longitude and latitude and time, a finish longitude and latitude and time, a goal time for completion of the track (course), waypoints which define longitude, latitude, altitude, and clock time and optionally wattage of the user along the track or course of the race.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF DRAWINGS

Figure 1:
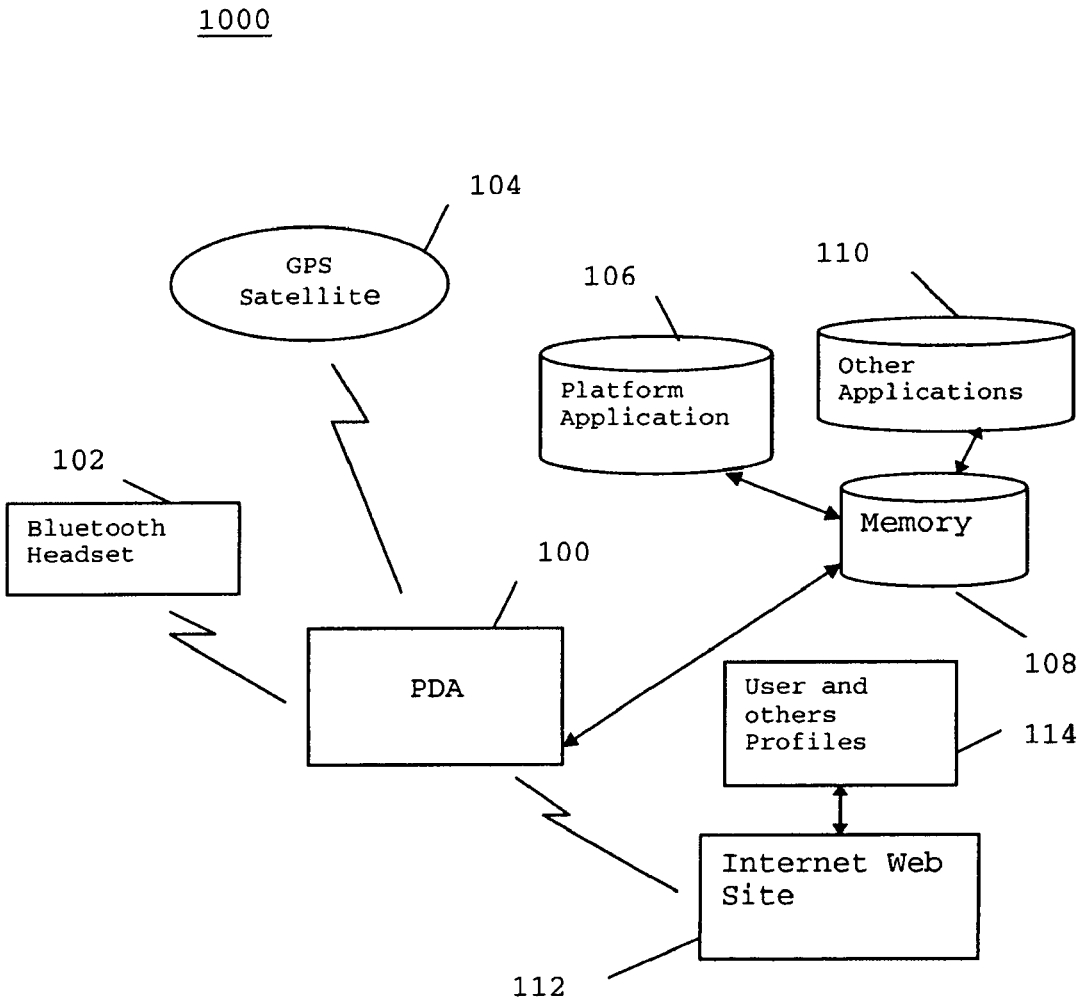
FIG. 1 is a block diagram showing the overall system of the present invention with its respective components.

FIG. 1 is a block diagram showing the overall system 1000 of the present invention with its respective components. The platform application of the present invention will run on PDA 100 or on another aforementioned device. The device memory 108 will store platform application 106 along with other applications 110 such as GPS, internet access, speech recognition, speech audio, phone, etc. User and others' track profiles 114 can be stored on Internet web site 112 and downloaded to the PDA memory (108). Users can upload their specific track profiles and download their previous profiles or track profiles of others. Once a target race has been determined, the user can download the target race profile from previous user profiles or other user profiles. The user will set a goal time for the race. The platform software will use the goal time to notify the user with audio and/or visual checkpoint updates to keep the user on the computed goal pace in order to achieve the goal time. PDA 100 will then store any downloaded profiles in memory 108. PDA 100 will communicate with GPS satellite(s) 104 for position and altitude data to determine user position at all times. Communication to a user is accomplished via wireless 'Bluetooth' compatible headset 102. It should be noted that although wireless communication is the preferred embodiment of the present invention, direct wire communication could also be implemented.

Figure 2:
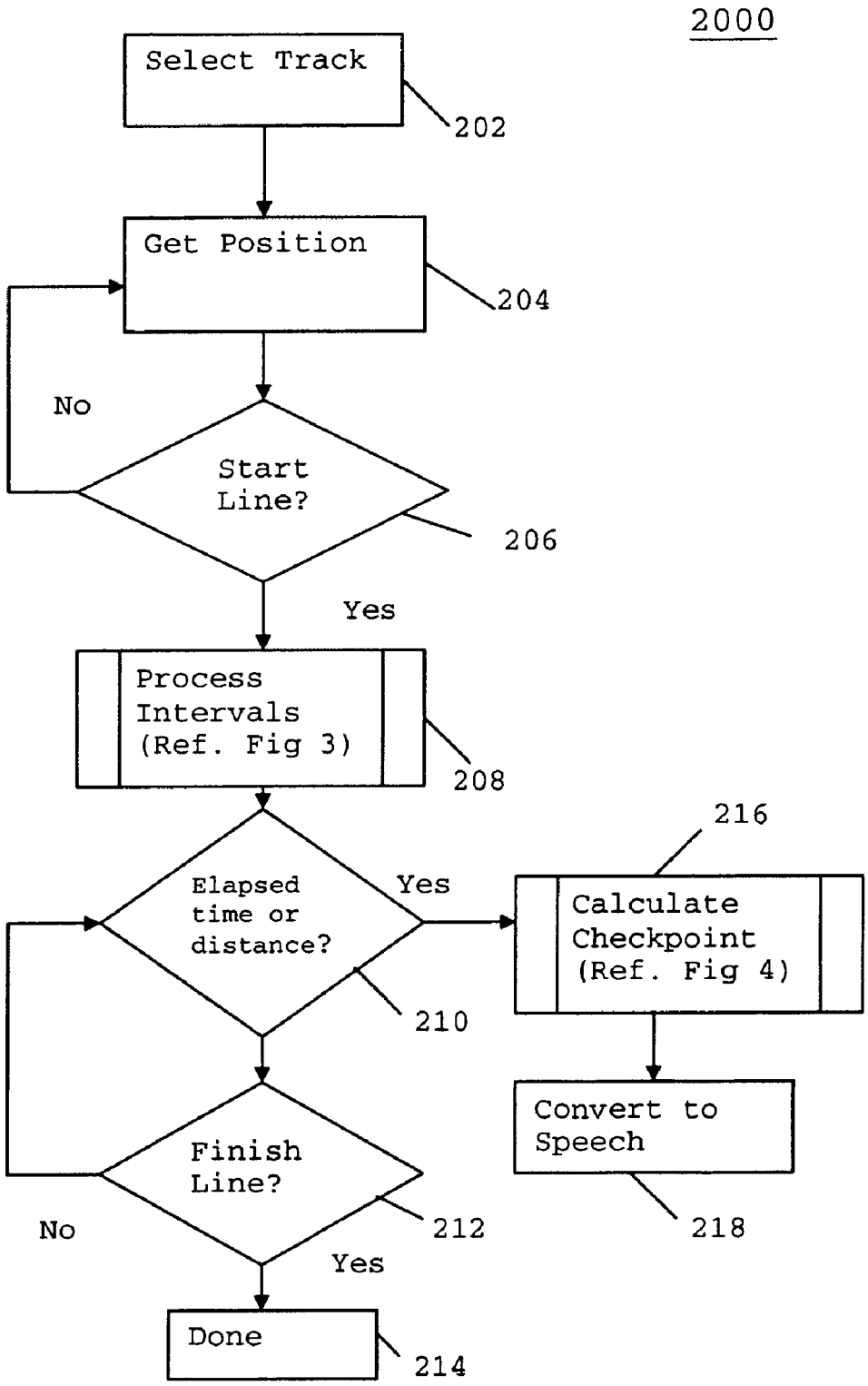
FIG. 2 is a flow chart of the platform application steps regarding pacing along a user track or course.

FIG. 2 is a flow chart of the platform application steps regarding pacing along a user track or course. In step 202 the user will select a track (or course) profile, which the user will navigate. The track profile can be pre-downloaded to the PDA from an Internet web site (ref. FIG. 1). Next, in step 204, the platform application will get the current GPS position of the user. The platform application will then, in step 206, determine if the start line has been crossed. If 'no' the application will continue to update the current user position. The platform application determines whether or not the start line has been crossed by comparing the start position (downloaded in the track profile), the current position and the previous position. In the case of a standing start the application software detects when the user starts moving. If the user sets up checkpoint intervals along the course, they will be processed in step 208 and will be further described below in the flowchart of FIG. 3. If either a specified elapsed time or distance (for example, user is at a checkpoint) has occurred, step 210, the platform application will calculate the checkpoint and convert it to speech for audible input to the user. The calculation of the checkpoint will be described in more detail in FIG. 4 below. The platform application will continually check the position to determine if the finish line has been crossed, step 212. It will determine if the finish line has been crossed by comparing the finish position, the current position and the previous position along with the direction of travel. The direction is used in case the course is set up to cross the finish line twice (once from one direction and once from the opposite direction). In the case that a number of laps have been pre-specified, the platform application will decrement a lap counter each time the finish line position has been crossed in order to detect the final finish. In calculating the checkpoint pace, step 216, the application software will calculate the time (for example, number of seconds) behind or ahead of the goal the user has set for the course. The system will then provide the user with an audio feedback, step 218, for example; '2.3 seconds behind'.

Figure 3:
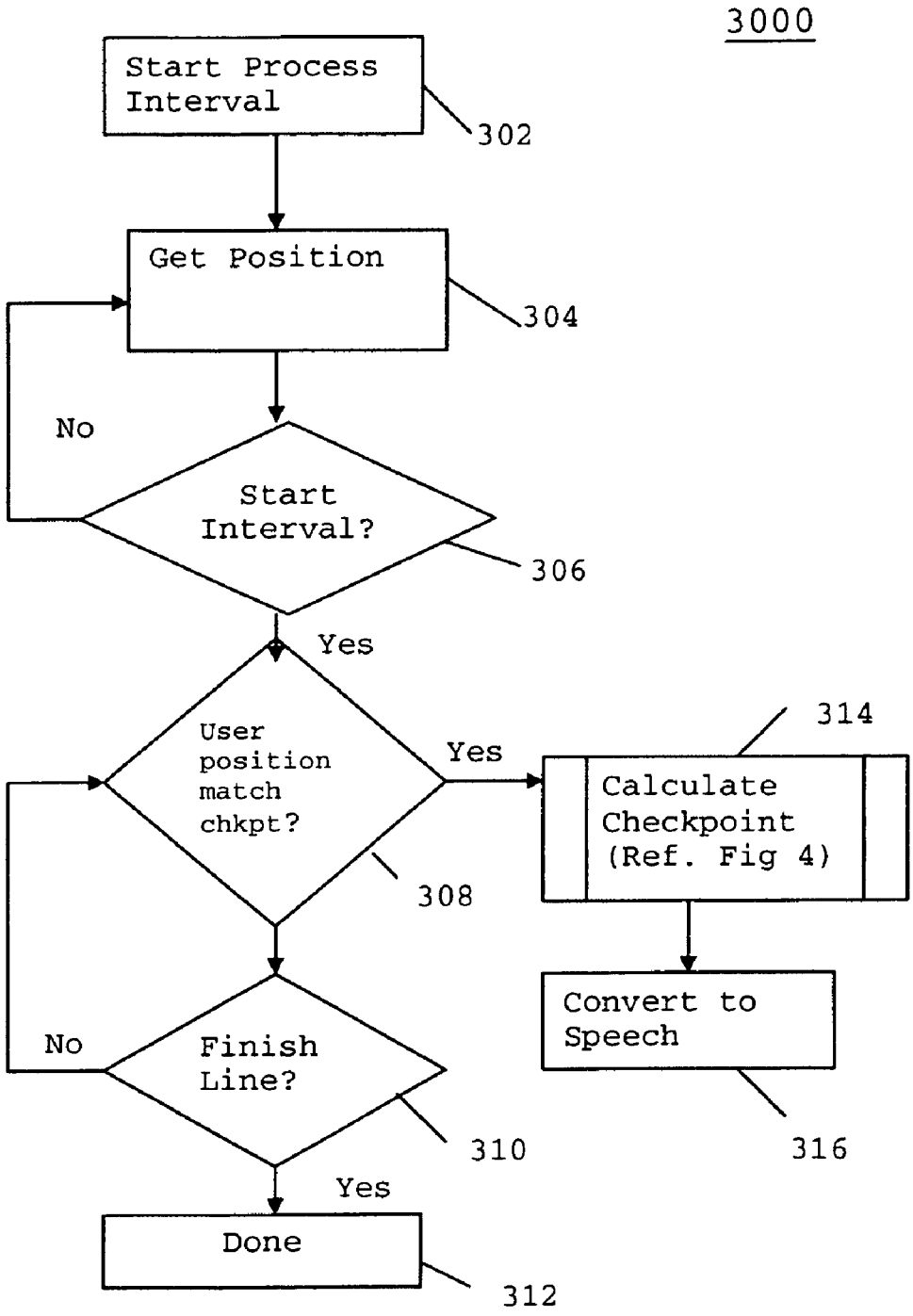
FIG. 3 is a flow chart of the interval monitoring process along a user track or course.

FIG. 3 is a flow chart of the interval monitoring process 3000 along a user track or course. The user can set up a series of intervals along a selected course. An interval is treated as a race within a race. It has a start and a stop point. An example of such an interval setup would be a basically flat course that has two hills within the course. The start of interval one would be the bottom of hill one and the finish could be the top of hill one. Likewise the second interval would be setup with the start at the bottom of hill two and the finish at the top of hill two. The user would receive checkpoints based on the start, waypoints along each hill and the top of each hill. Interval processing 3000 (reference step 208, FIG. 2) begins with step 302 to determine if one or more intervals have been setup. If setup, in step 304, the platform application will get the user GPS position and then compare it to the respective interval setup start point, step 306. If the positions do not match, it will go continue to update user position, step 304. If the system has detected that the user position has crossed the interval start position, step 314, the platform application will calculate the checkpoint time and, in step 316, convert it to a speech audible user input. The checkpoint calculation will be described in more detail in FIG. 4 below. The platform will continually monitor user position until an interval is completed at the interval finish point, step 310. Once the finish position of the interval is reached by the user, the specific interval monitoring process is complete, step 312.

Figure 4:
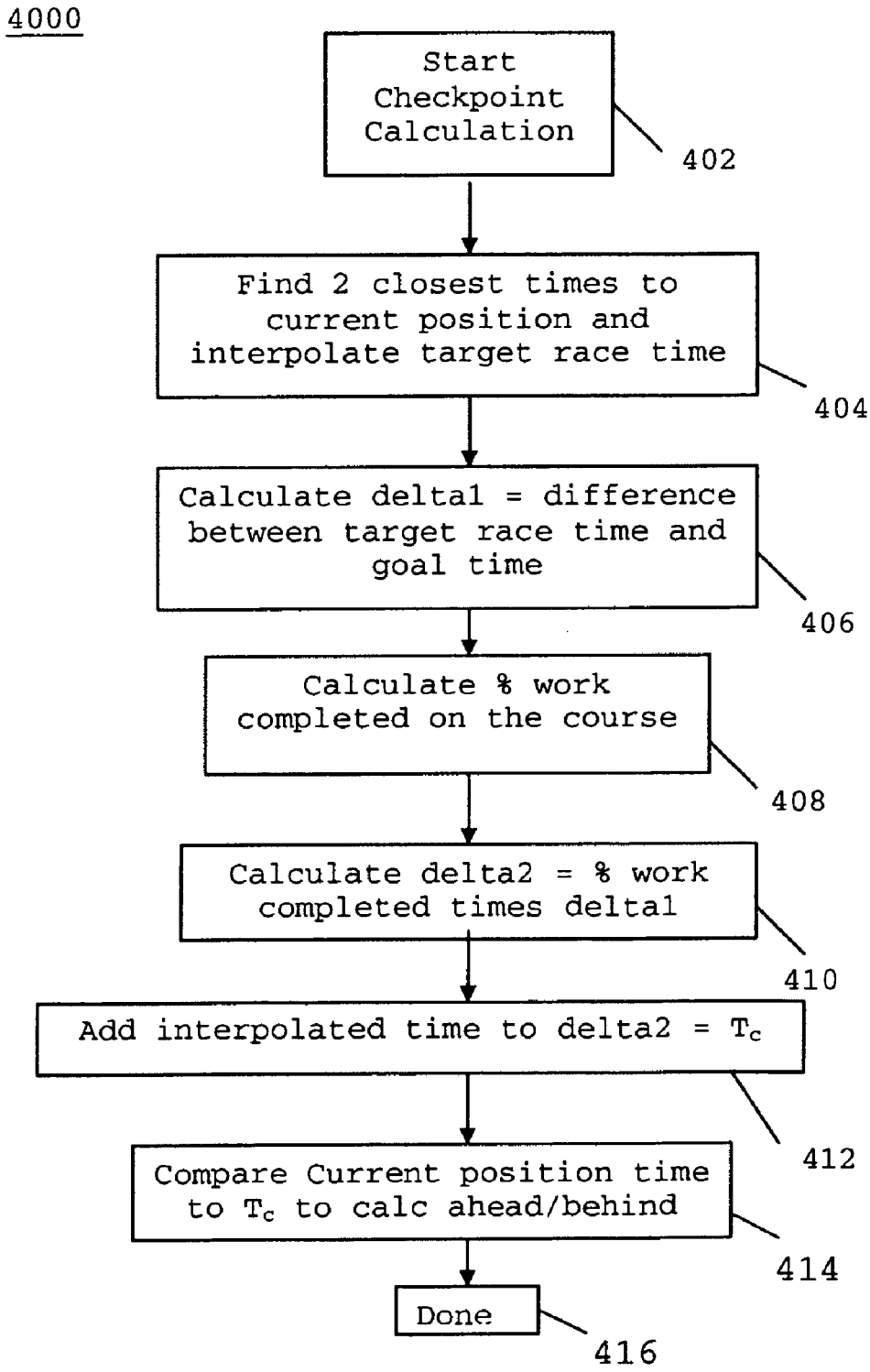
FIG. 4 is a flow chart of the algorithm used in calculation of a checkpoint regarding the user pace with respect to the target race time and final goal time.

FIG. 4 is a flow chart of the algorithm 4000 used in normalization calculation of a checkpoint regarding the user pace with respect to the target race time and final goal time. Step 402 begins the start of each checkpoint calculation, which is calculated by comparing the current position and time to the target races time at that position. Since time and position information is a discrete set of numbers, interpolation is used for greater accuracy. The interpolation used is linear interpolation which is the process of calculating unknown values from the known values when we assume a constant rate of change. An example of linear interpolation is as follows:

Assume the times at position p0 and at p1 are 0 and 1 hour respectively and that p1 is 10 miles away from p0. Using linear interpolation it would be determined that a position five miles away from p0 would yield a time of one half hour. i.e. (Delta time/Delta distance)*d will give the time at distance d. Thus, (1 hour/10 miles)*5 miles=½ hour.

In step 404 the closest two positions are looked up from the target profile and those two target times are interpolated to give an interpolated target time at the current position. Next, in step 406, the difference (Delta) between the total goal time and target race time is calculated (referred to as 'Delta 1'). If the goal time is different than the target race time, the delta will be distributed based on the percentage of work completed. In step 408 the percentage of work completed is calculated. A simple way to calculate the percentage of work completed would be to divide the total distance of the course by the elapsed distance. However, the algorithm of the present invention provides a more accurate way to calculate the percentage of work completed by taking the terrain of the course into account. For example, if a course went up a hill and then came back down a hill, the half way point based on distance would be the top of the hill but the half way point based on work would be somewhere between the start and the top of the hill. This is because more work is done going up the hill, in the first half of the course, versus going down the hill in the second half of the course. In step 410 the percentage of work completed is multiplied by 'Delta 1' (ref. step 404) and is referred to as 'Delta 2'. Next, in step 412, 'Delta 2' is added to the interpolated time at the current position to get a target time $T_c$. Next, in step 414, the target time $T_c$ is compared to the actual user time to determine the time the user is ahead or behind the final goal. Step 416 completes the calculations of the algorithm.

Example 1 of algorithm calculations for a course with a user goal time set at 10 minutes 45 seconds and a target race time from previous profiles of 10 minutes 50 seconds is as follows:

a) User time at a checkpoint '1' position is 1 minute 10 sec
b) Two closest positions to this checkpoint position and times interpolate to 1 minute and 5 seconds from the stored target profile.
c) Next, calculation of 'Delta 1' between target race time and goal time is: Delta 1=goal time minus target race time. Thus, 10 min 45 sec. goal time minus 10 min 50 sec. target race time results in a value of minus 5 sec.
d) Let's assume at this checkpoint that 80% of the course 'work' is completed, that is, the first part of course was hilly. Then 'Delta 2'=80% (work completed) times minus 5 sec (Delta1) resulting in Delta 2=minus 4 sec. Thus, this 4 sec is the time needed to be made up by the user.
e) At the current checkpoint the user time is 1 min 10 sec. Adding the interpolated target time (1 min 5 sec) to Delta 2 (minus 4 sec) results in a normalized target time ($T_c$) of 1 min and 1 sec
f) Comparing the actual user time (1 min 10 sec) to normalized target time (1 min 1 sec) results in a nine second difference. Thus in this example the user is 9 seconds behind at checkpoint '1' and an audible would be transmitted to the user stating "9 seconds behind".

As can be seen from the above example 1, the platform application of the present invention utilizes the percentage of work done over a given terrain to provide a much more accurate track in normalizing the user performance along a course. In the above example, if the goal time were the same as the track time, then 'Delta 1' would be zero and the user time of 1 min 10 sec would be compared to the interpolated track time of 1 min 5 sec, thus the user would receive an audible that would state "5 seconds behind".

Example 2 of algorithm calculations for a course with a user goal time of 29 minutes and a target race time of 29 minutes 30 seconds from previous profiles is as follows:

a) User time at a checkpoint '1' position is 5 minutes 10 sec
b) Two closest positions to this checkpoint position and times interpolate to 5 minutes and 22 seconds from the stored target profile.
c) Next calculation of 'Delta 1' between target race time and goal time is: Delta 1=goal time minus target race time. Thus, 29 min goal time minus 29 min 30 sec. target race time results in a Delta 1 value of minus 30 sec.
d) Lets assume at this checkpoint that 20% of the course 'work' is completed. Then 'Delta 2'=20% (work completed) times minus 30 sec (Delta 1) resulting in Delta2=minus 6 sec. This is the time needed to be made up
e) At the current checkpoint the user time is 5 min 10 sec. Adding the interpolated target time (5 min 22 sec) to Delta 2 (minus 6 sec) results in a normalized target time of 5 min and 16 sec
f) Comparing the actual user time (5 min 10 sec) at checkpoint '1' to normalized target time (5 min 16 sec) results in a 6 second difference. Thus in this example the user is 6 seconds ahead and an audible would be transmitted to the user stating "6 seconds ahead".

Figure 5:
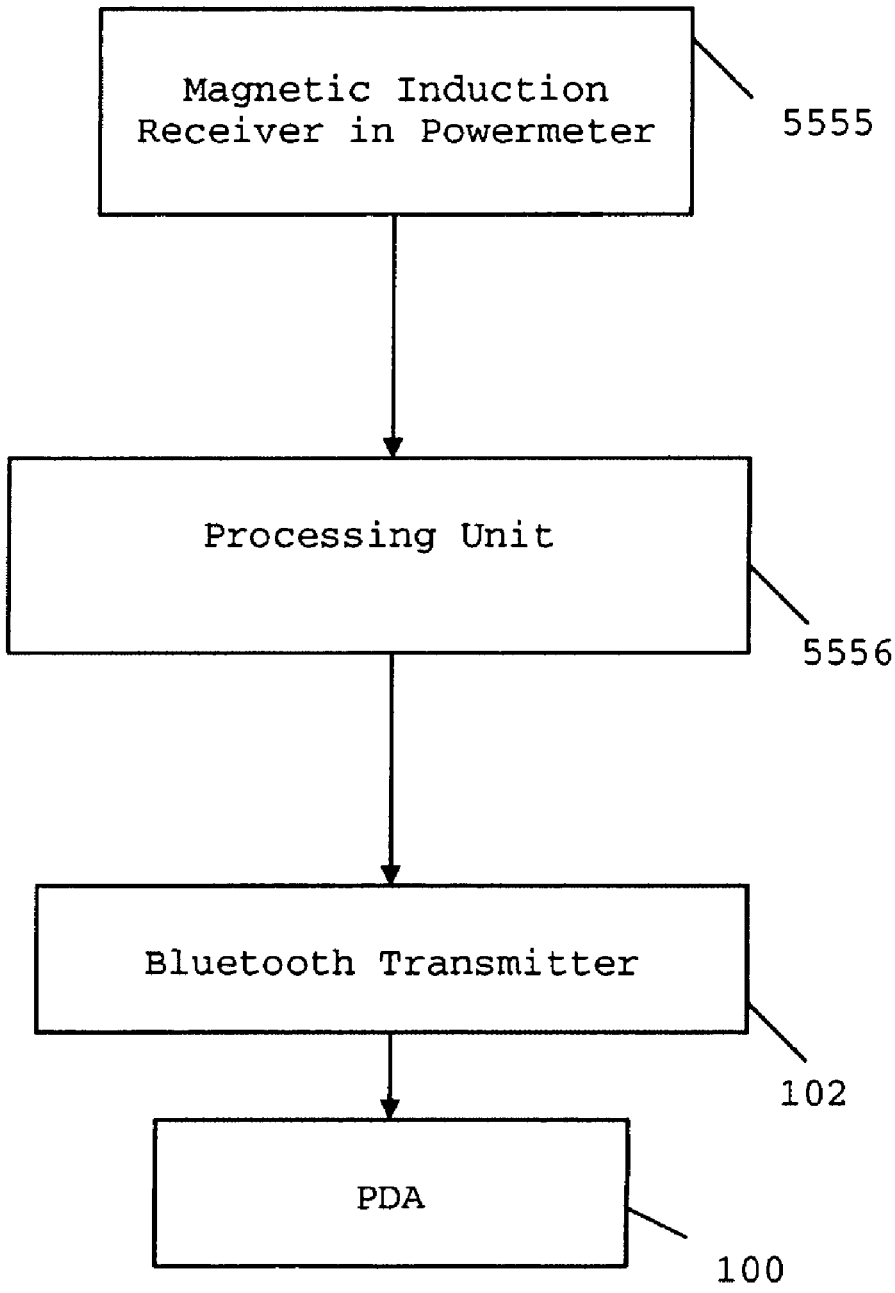
FIG. 5 is a flow chart of a power meter transmitting to the PDA100.

FIG. 5 is a flow chart of a power meter transmitting data to the PDA 100. There are several power measuring devices currently on the market. For example, the SRM™ power measuring crankarm.

Power is calculated using strain gauges built into the crankarm of a bicycle pedal crankarm and uses magnetic induction transmitted to magnetic induction receiver 5555, which then transmits the data via a wire to a processing unit 5556 which could be attached to the bicycle handlebars.

Getting this data into PDA 100 requires a magnetic induction receiver 5555 connected to a processing unit 5556 which converts the data into a wattage measurement and transmits the data to PDA 100 via a standard Bluetooth™ transmitter 102.

Once the wattage data is read from the power measuring device 5555, it will be combined with the GPS data to form waypoints along the route which consist of longitude, latitude, altitude, elapsed time, and wattage. This data will then be used to notify the user of how far ahead or behind they are of a target power at specified intervals of time or distance.

These data points can be used to calculate the effective wind speed at every point on the course via the following formulas:

Power_watts=(Drag*RelativeVelocity)+
(Weight*Gravity*Velocity*Grade)

(Note: * is multiply symbol)

Drag=0.5*Coef_friction*Air_density*Relative
Velocity*Relative Velocity*Frontal_area In the formula above RelativeVelocity is defined as the vector addition of the Velocity of the bike/rider and the wind speed. A more accurate goal pace can be calculated once this data has been collected. Using this data and the current wind speed and direction one can calculate how much faster or slower the rider will be due to the difference in wind speed. This delta time can be distributed across the course based upon the percent power expended along the course as discussed below.

The formula for calculating the percentage of work done at waypoint number p along a course defined by a series of 'n' number of waypoints $w^0$ . .$w^p$ . .$w^n$ defined by longitude, latitude, altitude and elapsed time is done in two steps as follows:

1. (Step 1) First calculate the total amount of work down by calculating the number of joules (watt-seconds) of energy exerted during the total course.

Total Work=ΣSummation ($i$=0 to $i$=$n$) of
Power_watts*$\Delta t$ where: Power_watts=(Drag*Relaltive Velocity )+(Weight*Gravity*Velocity*Grade)

and:

Weight=weight of bike and rider in kG (kilograms)

Velocity=speed of rider in meters per second calculated by $\Delta d/\Delta t$ where $\Delta d$ is the distance between waypoint $w^n$ and $w^{n+1}$ and $\Delta t$ (sec) is the difference in elapsed time between the two waypoints.

Grade=grade of the road between waypoint $w^n$ and $w^{n+1}$

Further defined by this formula:

$$\text{Grade}=((a^{n+1}-a^n)*100)/d$$

Where $a^n$ is the altitude (meters above sea level) at waypoint $w^n$ and $a^{n+1}$ is the altitude at $w^{n+1}$ and d is the distance(meters) between $w^n$ and $w^{n+1}$ Frontal_area=0.44704; (approximate number of square meters of bicycle and rider)

Air_density=1.177 kg/m$^3$ (at standard ambient temperature and pressure)

Coef_friction=1.0

Gravity=9.8 meters/sec$^2$

Drag=0.5*Coef_friction*Air_density*RelativeVelocity*RelativeVelocity*Frontal_area 2. (Step 2) Now calculate the work done up to waypoint $w^p$ $$\text{Partial}=\Sigma\text{Summation } (i=0 \text{ to } i=n) \text{ Power_watts}*\Delta t$$

Therefore, the percent of work done at waypoint $w^p$=Partial*100/Total

Figure 6:
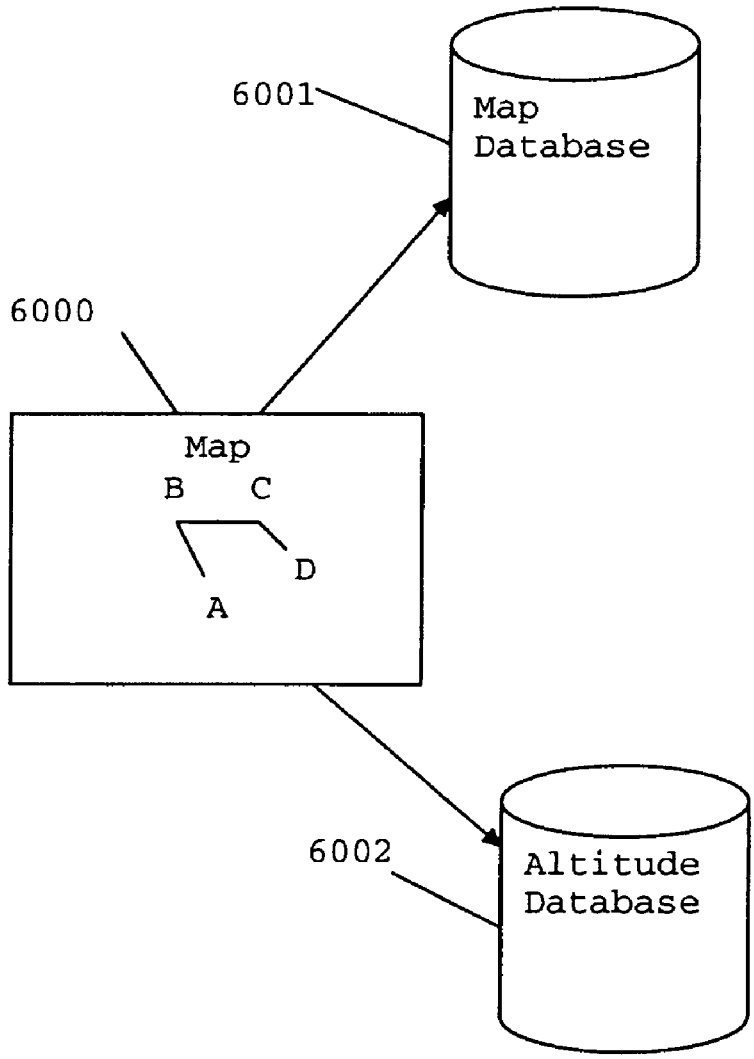
FIG. 6 is a flow chart of a map based route.

FIG. 6 is a flow chart of a map based route used to calculate waypoints at specified intervals along a route defined by a user selecting points on a map displayed at a web site.

The method comprises the following steps:

1. The user logs on to the web site and a map 6000 is displayed using Google® map or Microsoft® Virtual Earth mapping Application Programming Interfaces (api's) or other equivalents;
2. The user selects the start at point (A); a right turn at point B; another right at point C; and the finish at point D;
3. The longitude and latitude are looked up in the map database 6001 for each point (Google or Microsoft etc. provide these databases);
4. An interval is selected. For example 100 meters.
5. Points along the route (waypoints) are calculated by starting at position A and traveling in the direction from A to B and moving the point at A the interval distance (100 meters) all the way to point B, then B to C, then C to D;
6. At this point the route is defined every 100 meters by waypoints which have the longitude and latitude known for each waypoint;
7. For each waypoint along the route the altitude is retrieved from the Altitude database 6002. The U.S. Geological Survey (USGS) has an Altitude database which can be used for this purpose.
8. The user inputs an average power (p) in watts over the course so that the speed can be calculated at each waypoint. The user could optionally enter in the weight of the rider and bicycle (weight); the AirDensity; the frontal area of the rider and bike (FrontalArea) or use the defaults supplied by creating constants.
9. The speed at each waypoint is defined by use of the following formulas is:

1. Solve for a temporary variable Temp=(6.75*AirDensity$^2$*CoefFriction$^2$*FrontalArea$^2$×Power+6.75*AirDensity*(AirDensity*CoefFriction$^4$*FrontalArea$^4$*Power$^2$+CoefFriction$^3$* FrontalArea$^3$*Weight$^3$*(0.2962962962962963*Grade$^3$*Gravity$^3$))$^{3/2}$)$^{(1/3)}$ 2. Then solve for speed via Velocity=Weight*1.259921049894873*Grade*Gravity/Temp+0.5291336839893999*Temp/(AirDensity*CoefFriction*FrontalArea)

10. Knowing the distance and speed at each waypoint the time between waypoints can be calculated.
11. Now that the elapsed time for each waypoint is known they can be summed to calculate the total time for the course.
12. The user can adjust the power up or down to re-calculate the total elapsed time for the course and use that for the target race.
13. The data which consists of longitude, latitude, altitude and elapsed time can be downloaded to the PDA 100 (ref. FIG. 1) and used to race against.

Although the present invention has been described with reference to preferred embodiments, numerous modifications and variations can be made and still the result will come within the scope of the invention. No limitation with respect to the specific embodiments disclosed herein is intended or should be inferred.

I claim:

1. A method to facilitate physical training, the method comprising the steps of:

having a user wear a GPS logging device which includes a user output interface;

having the user travel through a race course;

automatically logging a plurality of waypoints along the race course;

entering into the GPS logging device a checkpoint interval based either on a time interval or a distance interval;

having the user select a finishing goal time and entering it into the GPS logging device;

having the user travel through the race course a second time;

automatically logging a plurality of waypoints along the race course for the second travel through the race course;

receiving from the GPS logging device at the check-point interval, a calculated delta indicating a comparison between the user's first and second elapsed time or distance histories during the user's second travel through the race course;

receiving from the GPS logging device at each of the checkpoint intervals a signal indicating how far ahead or behind the user is at that position based on the finishing goal time during the user's second travel through the race course calculated using the following normalization algorithm:

a. calculating a (first interpolated time) at the checkpoint interval through the process of selecting the closest two positions to the current position from the elapsed time history of the first travel through the race course and using the two positions to interpolate what the user's first time was at the user's current position;

b. calculating a Delta1 comprising a difference between the user's first total elapsed time for the course and the finishing goal time;

c. calculating a percentage of work completed using the formula:

(first interpolated time)/(user's first total elapsed time for the course)

d. calculating a Delta2 comprising the formula:

(percentage of work completed)×(Delta1)

e. adding Delta2 to the (first interpolated time) to get a target time (Tc)

f. comparing the elapsed time at the current checkpoint to Tc to determine the time the user is behind or ahead of the goal time; and g. notifying the user of being time "behind" or time "ahead" at the current checkpoint.

2. The method of claim 1 further comprising the steps of uploading the first elapsed time history to a web site;

a) next downloading to the GPS logging device an elapsed time history of the first user, then comparing a second user's travel through the race course to the downloaded history of the first user;

b) using the normalization algorithm of claim 1 adjusting the first elapsed time histories for display to the second user; and c) uploading the second elapsed time histories to the website.

3. The method of claim 1 further comprising the steps of notifying the user of being distance "ahead" or distance "behind" using the following steps:

a. using the normalization algorithm of claim 1 for determining the time "ahead" or "behind" at a checkpoint interval;

b. calculating a first interpolated time at the checkpoint interval through the process of selecting the closest two positions to the current position from the elapsed time history of the first travel through the race course and using the two positions to interpolate what the user's first time was at the user's current position;

c. if the user is "ahead" at a checkpoint, subtract the time ahead from the first interpolated time to get the target time (Tt); if the user is "behind" at the checkpoint, add the time behind to the (first interpolated time) to get the target time (Tt);

d. calculating an interpolated position through the process of selecting the closest two times to the target time (Tt) from the elapsed time history of the first travel through the race course;

e. calculating the distance from the interpolated position to the current position along the path taken defined by the elapsed time history of the first travel through the race course; and f. notifying the user of being distance "behind" or distance "ahead" at the current checkpoint.

* * * * *